US009907399B2

(12) United States Patent
Lucas

(10) Patent No.: US 9,907,399 B2
(45) Date of Patent: Mar. 6, 2018

(54) DEVICE FOR RELEASABLY CONNECTING A FURNITURE DRAWER TO A GUIDANCE UNIT THAT MOVEABLY GUIDES THE DRAWER IN A FURNITURE BODY

(71) Applicant: Grass GmbH, Höchst (AT)

(72) Inventor: Tim Lucas, Leinfelden-Echterdingen (DE)

(73) Assignee: Grass GmbH, Höchst (AT)

( * ) Notice: Subject to any disclaimer, the term of this patent is extended or adjusted under 35 U.S.C. 154(b) by 0 days.

(21) Appl. No.: 15/286,033

(22) Filed: Oct. 5, 2016

(65) Prior Publication Data

US 2017/0095083 A1 Apr. 6, 2017

(30) Foreign Application Priority Data

Oct. 5, 2015 (DE) ..... 20 2015 006 943 U

(51) Int. Cl.
*A47B 88/04* (2006.01)
*A47B 88/423* (2017.01)

(52) U.S. Cl.
CPC ..... *A47B 88/0422* (2013.01); *A47B 88/423* (2017.01); *A47B 2088/0437* (2013.01)

(58) Field of Classification Search
CPC ... A47B 88/407; A47B 88/423; A47B 88/427; A47B 88/43; A47B 88/944; A47B 88/95; A47B 88/958; A47B 2088/4235; A47B 2088/4272; A47B 2088/4274; A47B 2088/4276
See application file for complete search history.

(56) References Cited

U.S. PATENT DOCUMENTS 5,580,139 A * 12/1996 Grabher ..... A47B 88/427 312/333
7,549,712 B2 * 6/2009 Booker ..... F16F 9/0218 312/333
9,066,587 B1 6/2015 Liang et al.
9,095,211 B2 8/2015 Amann et al.
(Continued)

FOREIGN PATENT DOCUMENTS

DE 202004015100 U1 2/2006
DE 202007001782 U1 1/2008
(Continued)

OTHER PUBLICATIONS

European Search Report in corresponding European Application No. 16190720.9, dated Feb. 13, 2017.
(Continued)

*Primary Examiner* — Daniel J Rohrhoff
(74) *Attorney, Agent, or Firm* — Edell, Shapiro & Finnan, LLC

(57) ABSTRACT

A device for releasably connecting a furniture pull-out to a guidance unit that movably guides the pull-out in a furniture body comprises: a base part; and an adjuster arranged on the base part and comprising a plurality of components movable in relation to one another, the adjuster enabling a position of the furniture pull-out to be set in at least one spatial direction relative to the guidance unit, the adjuster including a spring-loaded contact pressure mechanism configured to press the guidance unit against the device in a fitted and working condition.

7 Claims, 3 Drawing Sheets

(56) References Cited

U.S. PATENT DOCUMENTS

| | | | | |
|---|---|---|---|---|
| 2008/0218045 | A1 | 9/2008 | Moser | |
| 2012/0292465 | A1* | 11/2012 | Holzer | A47B 88/0422 248/201 |
| 2013/0113356 | A1* | 5/2013 | Salice | A47B 88/0422 312/334.44 |
| 2013/0293077 | A1* | 11/2013 | Haemmerle | A47B 88/0085 312/319.1 |
| 2015/0147008 | A1* | 5/2015 | McGregor | A47B 88/0422 384/22 |

FOREIGN PATENT DOCUMENTS

| | | | |
|---|---|---|---|
| DE | 202011104673 | U1 | 11/2012 |
| DE | 202013004939 | U1 | 9/2014 |
| DE | 212013000112 | U1 | 12/2014 |
| EP | 0695523 | B1 | 2/1998 |
| WO | 2008028809 | A1 | 3/2008 |
| WO | 2012068594 | A1 | 5/2012 |
| WO | 2013152365 | A1 | 10/2013 |

OTHER PUBLICATIONS

German Search Report in corresponding German Application No. 202015006943.6, dated Sep. 26, 2016.

* cited by examiner

DEVICE FOR RELEASABLY CONNECTING A FURNITURE DRAWER TO A GUIDANCE UNIT THAT MOVEABLY GUIDES THE DRAWER IN A FURNITURE BODY

CROSS REFERENCE TO RELATED APPLICATIONS

This application claims foreign priority under 35 U.S.C. § 119(a)-(d) to German Patent Application No. DE 202015006943.6 filed on Oct. 5, 2015, the entire contents of which are hereby incorporated by reference.

FIELD OF THE INVENTION

The invention relates to a device for releasably connecting a furniture pull-out such as a drawer to a guidance unit that movably guides the drawer in a furniture body. The device includes a base part, on which an adjuster, belonging to the device and comprising a plurality of components movable in relation to one another, is arranged, via which a position of the furniture pull-out connected to the guidance unit relative to the guidance unit in at least one spatial direction with respect to the guidance unit can be set, and wherein a stop mechanism is provided, which delimits a travel of the adjuster.

BACKGROUND

A device of this type is known, by way of example from EP 0 695 523 B1 or alternatively from DE 20 2011 104 673. Such devices are used for coupling the guidance unit with a furniture pull-out, so that the furniture pull-out, by way of example a drawer, can if necessary be separated from the guidance unit.

Thus it can be removed by itself from the furniture body, whereby it is possible for the guidance unit to be mounted permanently in the body.

Such devices serve, in addition to the coupling of the furniture pull-out and the guidance unit, for adjusting the position of the furniture pull-out in relation to the guidance unit. This is important, in order to set at the front of the furniture pull-out in its closed position an even joint arrangement or an even gap width between the edges of the front of the furniture pull-out and the surrounding furniture body. To this end, it is possible to adjust the height or also the lateral positioning of the furniture pull-out via the device. A tilt or depth adjustment of the furniture pull-out with respect to the guidance unit is also conceivable.

It is possible to equip the device or coupling with an adjuster, which allows only an adjustment in one of the spatial directions, or alternatively to fit it with an adjuster that allows adjustment in a plurality of spatial directions, for example two or three.

If it is intended for the adjuster to allow a height adjustment of the furniture pull-out in relation to the guidance unit, then the device is mounted so that between the floor of the furniture pull-out and the guidance unit, in particular the associated slide rail, play in the vertical direction is present. This play in the system is, however, inconvenient.

SUMMARY

The object of the invention is to provide a device of the abovementioned type, which compared with conventional devices is more functionally reliable in use.

This object is achieved by a device for releasably connecting a furniture pull-out to a guidance unit that movably guides the furniture pull-out in a furniture body in the manner described herein.

The device according to the invention is characterized in that the adjuster has a spring-loaded contact pressure mechanism, whereby the device in a fitted and working condition is pushed onto the guidance unit.

Because the device or coupling in the fitted and working condition is pushed against the guidance unit, in particular the slide rail, the inconvenient play in the furniture pull-out-guidance unit system is reduced.

In a further development of the invention, the contact pressure mechanism is designed so that a relative mobility between the furniture pull-out and guidance unit in the vertical direction is present to allow height adjustment of the furniture pull-out with respect to the guidance unit. It is thus possible to apply a pressure burden to the springy-elastic contact pressure mechanism with the reduction in the distance between the furniture pull-out and the slide rail as a result of the height adjustment.

In a particularly preferred manner, the contact pressure mechanism has at least one spring element or are formed of at least one spring element. It is by way of example possible to combine spring element and rigid pressure piece impinged on by the spring element.

In a further development of the invention the adjuster has a side adjuster unit for setting the position of the furniture pull-out relative to the guidance unit transversally to a longitudinal direction of the guidance unit, wherein the components of the side adjuster unit comprise an adjusting element and a coupling element movable relative to the adjusting element, that is or can be coupled to the guidance unit, for lateral adjustment of the furniture pull-out with respect to the guidance unit.

The adjuster can additionally or alternatively have a height adjuster unit for setting the position of the furniture pull-out in the vertical direction to the guidance unit.

It is possible that the adjusting element is designed as an adjusting wheel and the coupling element has a base section for coupling with an associated section of the guidance unit and a threaded shaft onto which the adjusting wheel is screwed.

In a particularly preferred manner, the contact pressure mechanism of the side adjuster unit is in particular associated with its coupling element, such that in the working condition of the device the contact pressure mechanism is supported on a support surface on the guidance unit and the side adjuster unit together with the device is pushed against the guidance unit.

Advantageously the contact pressure mechanism is a component of the coupling element, in particular formed on the coupling element.

In a particularly preferred manner, the coupling element is made of plastic. Advantageously, the contact pressure mechanism is molded onto the coupling element.

In a particularly preferred manner, the spring element of the contact pressure mechanism protrudes away from the coupling element in the vertical direction and in the working condition of device is supported on the support surface of the guidance unit.

It is possible for the spring element to take the form of a contact tongue in particular comprising the material of the coupling element, which is spring-mounted on the remainder of the coupling element.

The invention further comprises a piece of furniture, with a furniture pull-out, which is movably guided relative to a furniture body via a guidance unit, wherein the piece of furniture is characterized by the aforementioned device.

BRIEF DESCRIPTION OF THE DRAWINGS

An example embodiment of the invention is shown in the drawing and is explained in the following. The drawing shows as follows.

DETAILED DESCRIPTION

Figure 1:
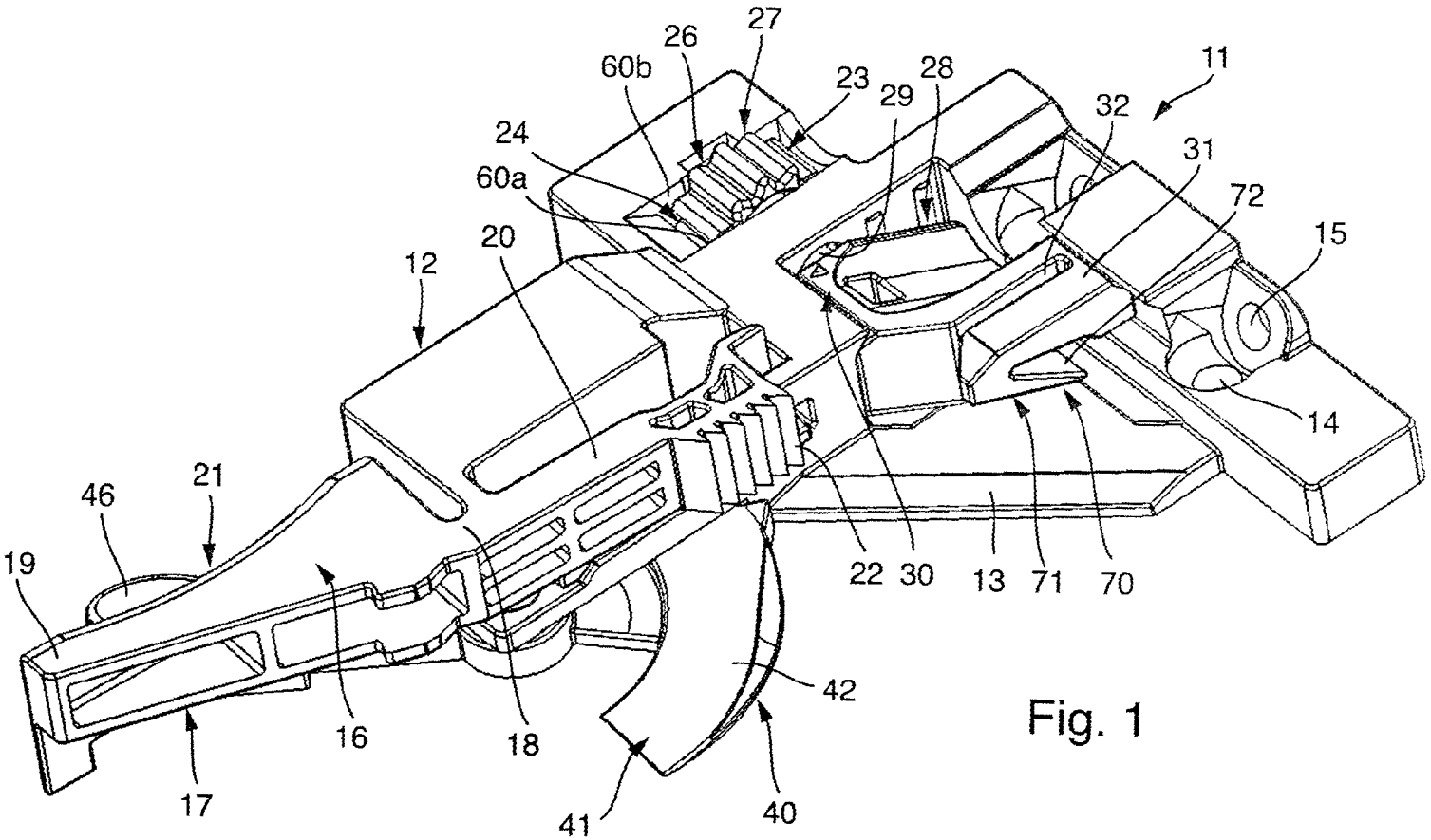
FIG. 1 is a perspective top view of a preferred embodiment of the device according to the invention.
Figure 2:
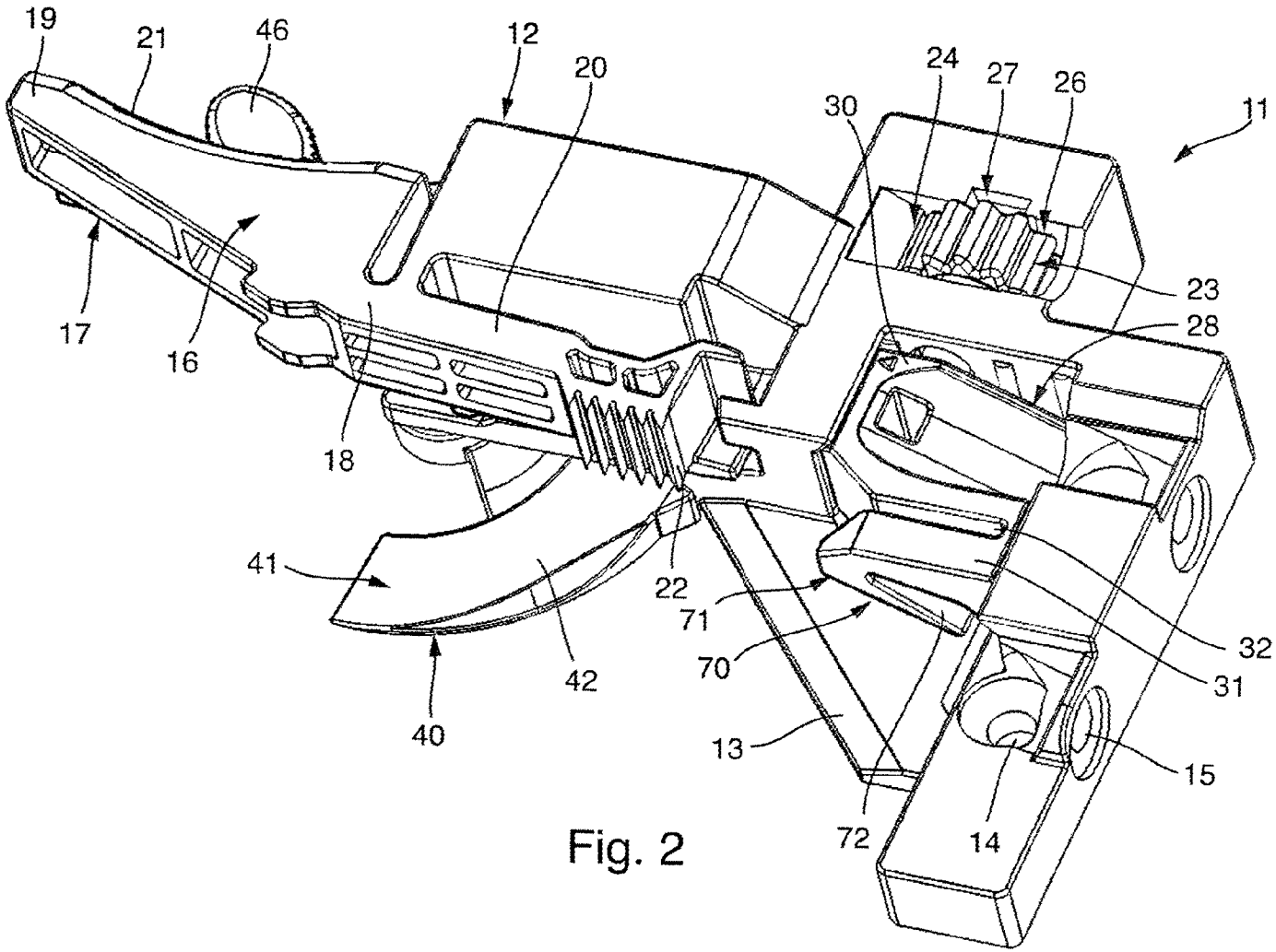
FIG. 2 is a perspective side view of the device from FIG. 1.
Figure 3:
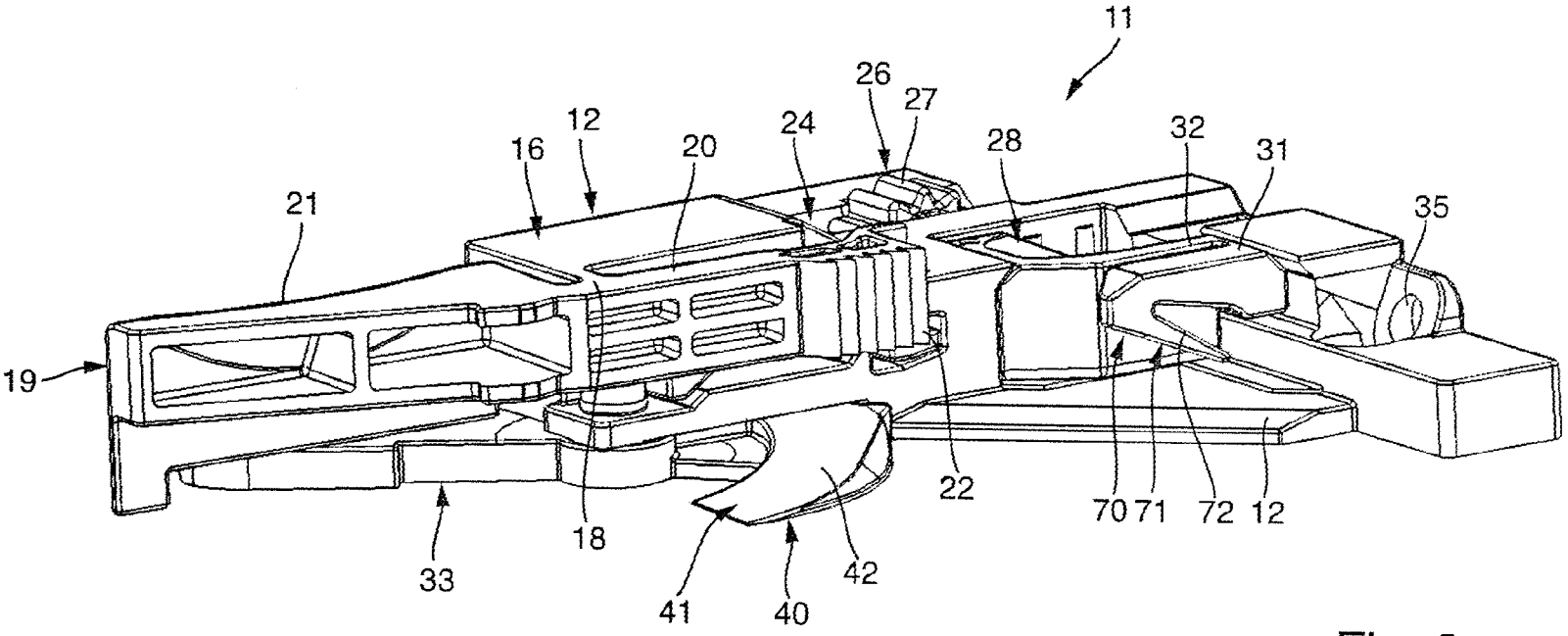
FIG. 3 is a perspective top view of the device from FIG. 1 from a direction different from FIG. 1.

FIGS. 1-3 show an example embodiment of the device 11 according to the invention, which serves for releasably connecting a furniture pull-out, which is movably guided in a furniture body via a guidance unit (not shown), to the guidance unit.

The device 11 is in the following, as an example case, illustrated as a furniture pull-out configured as a drawer.

The drawer is movably supported via the at least one guidance unit relative to the furniture body. Advantageously, a plurality of guidance units is provided, of which two are associated with opposing sides of the drawer. The guidance units can be components of what is known as an underfloor guidance, in which the guidance units are associated with the drawer bottom. An alternative possibility would be to incorporate the guidance units in the side wall or frame of the drawer. The device according to the invention 11 serves as a connecting element between the guidance unit and the drawer. The device 11 could therefore also be referred to as a coupling.

The device 11 has a housing-like base part 12, comprising plastic and is advantageously manufactured by injection molding. The base part 12 has a baseplate 13 with guiding holes 14 for securing to the floor of a drawer via suitable fastening elements, for example screws. The front of the baseplate 13 is broader than the rest of the baseplate 13, wherein on the front substantially perpendicular to the baseplate 13, through-holes 15 are provided, via which a securing to a side wall protruding downwards beyond the floor or on the front, in particular front panel, of the drawer is possible. A support section 16 with an elongated form rises up over the baseplate 13 of the base part 12.

A further component of the device 11 is a lever-like adjusting element 17, which via at least one flexure bearing 18 is formed on the support section 16 of the base part 12. The adjusting element 17 similarly comprises plastic and was injection molded onto the base part 12 at the same time that this was manufactured. Advantageously, the adjusting element 17 is made from the same plastic material, whereby the production costs are low because it can be made by single-component injection molding.

The adjusting element 17 is supported so that it can swivel via the flexure bearing 18 on the support section 16. The adjusting element 17 has an operating section 19 that can be manually operated, having a handle design. The operating section 19 is positioned on one side of the flexure bearing 18, wherein on the other side an engagement section 20 is provided, which is provided to engage in complementary engagement mechanism (not shown) on the guidance unit.

As shown in particular in FIG. 1, the handle-like operating section 19 has a wedge-like design, wherein on the outside of the operating section 19 an if necessary curved operating surface 21 is provided, for gripping via the fingers of the user. On the other side of the flexure bearing 18, the engagement section 20 is provided with a catch mechanism in the form of catch teeth 22. The catch teeth 22 on the engagement section are in the mounted state of the device 11 latched with complementary catch teeth, not shown, on the guidance unit, whereby the drawer is coupled to the guidance unit. Through pressure applied by the finger of the user to the operating surface 21 the adjusting element is able to swivel in the clockwise direction about the flexure bearing 18, wherein the engagement section with the catch teeth 22 swivels in the direction of the support section 16 of the base part 12, whereby catch teeth 22 on the adjusting element 17 unlatch from the complementary catch teeth on the guidance unit.

The device 11 also has an adjuster 23 comprising a plurality of components movable in relation to one another. The adjuster can set a position of the drawer connected to the guidance unit relative to the guidance unit in at least one spatial direction with respect to the guidance unit.

As shown in particular in FIG. 1, the device 11 is configured as what is known as a 2D-coupling.

In the example case shown the adjuster 23 comprises a side adjuster unit 26 for setting the position of the drawer relative to the guidance unit transversally to a longitudinal direction of the guidance unit.

As shown in particular in FIG. 1, the components of the side adjuster unit 26 comprise an adjusting element 27 and a coupling element 28 movable relative to the adjusting element 27, that is or can be coupled to the guidance unit, for lateral adjustment of the furniture pull-out with respect to the guidance unit.

As further shown in FIG. 1, the adjusting element 27 is in the form of an adjusting wheel. The coupling element 28 has a threaded shaft 29, onto which the adjusting wheel is screwed.

As shown in particular in FIG. 1, the coupling element 28 also has, apart from the threaded shaft 29, a base section 30, from one side of which the threaded shaft 29 extends and on the other a wedge-shaped coupling section 31 is attached.

The coupling element and the adjusting wheel screwed onto it are, like the base part 12, plastic injection-molded parts.

In the intended assembled state, the adjusting wheel is held in a holding receptacle 24 with an in particular rectangular design, which is open both to the mounting side 33 and to the operating side. The holding receptacle 24 has two opposing longitudinal walls 60*a*, 60*b*, which are upstream in the direction of one of the faces of the adjusting wheel and upstream in the opposite direction of the other. The adjusting wheel cannot therefore move in the longitudinal direction of the threaded shaft.

The base section 30 of the coupling element 28 can be configured as a hollow body, which in the example case shown is reinforced by ribs extending in the longitudinal direction of the threaded shaft 29. This results in a saving in materials when manufacturing the coupling element 28.

As in particular shown in FIG. 1, the wedge-shaped coupling section 31 has a holding slot 32 extending transversally, in particular, vertically to the longitudinal axis of the threaded shaft 29. The holding slot 32 serves to hold the holding section of the guidance unit, in particular of a wall section of a sliding or drawer rail of the guidance unit.

The adjuster 23 further comprises a contact pressure mechanism 70, whereby the device 11 in a fitted and working condition is pressed against the drawer rail of the guidance unit.

As in particular shown in FIG. 2, the contact pressure mechanism 70 has a spring element 71. In the example case shown, the spring element 71 has a contact tongue 72 formed on the coupling element 28, which protrudes from the coupling section 31 of the coupling element 28 in the vertical direction diagonally downwards.

In the example case shown, the contact tongue is molded in one piece with the coupling section 31. It therefore similarly comprises a plastic material.

The contact tongue 72 rests on a support surface (not shown) of the drawer rail, such that the side adjuster unit 26 together with the device 11 and the coupled drawer is pushed on the drawer rail.

As in particular shown in FIG. 1, the adjuster also has a height adjuster unit 40 for setting the position of the drawer relative to the guidance unit in the vertical direction. The height adjuster unit 40 has, as shown in particular in FIGS. 1 and 2, a wedge-shaped, more or less semi-circular ramp 41, supported on the mounting side 33 of the base part, in the region of the support section 16, so that it can pivot about a pivot axis. The effective wedge surface 42 of the ramp 41 engages in the gap between the top of the drawer rail or slide rail and the drawer floor. The ramp 41 can be adjusted by a handle 46 extending radially outwards located on the ramp 41, whereby optionally a larger or smaller section of the wedge surface 42 in the vertical direction protrudes into the gap and thus leads to an increase or a decrease in the distance between the drawer floor and the slide rail, allowing the drawer to be set in the vertical direction.

On the outer circumference of the semi-circular ramp 41, a detent is provided, with a number of catch teeth, which interact with projections formed on the baseplate 13. In this way it is possible to fix the set position of the height adjuster unit 40.

When adjusting the elevation of the drawer with respect to the drawer for setting the gap dimension at the front, the height adjuster unit 40 is operated as described. When reducing the distance between the drawer floor and the drawer rail the contact pressure mechanism 70, in particular the contact tongue 72, does not constitute a hindrance as application of a pressure burden is possible. In so doing, the contact tongue 72 can be pressed in the direction of the coupling section 31.

For adjusting the lateral position of the drawer, by turning the adjusting wheel a movement of the threaded shaft can be generated in one or other direction, whereby the drawer moves relative to the drawer rail.

What is claimed is:

1. A device for releasably connecting a furniture pull-out to a guidance unit that movably guides the furniture pull-out in a furniture body, comprising:

a base part; and an adjuster arranged on the base part and enabling a position of the furniture pull-out to be set in at least one spatial direction relative to the guidance unit, wherein the adjuster includes a spring-loaded contact pressure mechanism configured to press the guidance unit against the device in a fitted and working condition, and a side adjuster unit to set the position of the furniture pull-out relative to the guidance unit, wherein the side adjuster unit comprises an adjusting element and a coupling element movable relative to the adjusting element that is capable of being coupled to the guidance unit for lateral adjustment of the furniture pull-out with respect to the guidance unit, and wherein the contact pressure mechanism is disposed on the coupling element such that, in a working condition of the device, the contact pressure mechanism is supported on a support surface on the guidance unit and the side adjuster unit together with the device is pushed against the guidance unit.

2. The device according to claim 1, wherein the contact pressure mechanism is formed so that a relative mobility between the furniture pull-out and the guidance unit in the vertical direction is present to allow height adjustment of the furniture pull-out with respect to the guidance unit.

3. The device according to claim 1, wherein the contact pressure mechanism comprises at least one spring element.

4. The device according to claim 1, wherein the coupling element comprises plastic and the contact pressure mechanism is molded onto the coupling element.

5. The device according to claim 1, wherein the contact pressure mechanism comprises a spring element that protrudes away from the coupling element in the vertical direction and in the working condition of device is supported on the support surface of the guidance unit.

6. The device according to claim 5, wherein the spring element comprises a contact tongue in the material of the coupling element, which is spring-mounted on a remainder of the coupling element.

7. A piece of furniture, comprising:

a furniture body;

a furniture pull-out that is movably guided relative to the furniture body via a guidance unit; and the device according to claim 1.

* * * * *